United States Patent [19]

Fey

[11] Patent Number: 4,763,498

[45] Date of Patent: Aug. 16, 1988

[54] OPERATING DEVICE FOR A CENTRAL LOCKING INSTALLATION

[75] Inventor: Rainer Fey, Schweinfurt, Fed. Rep. of Germany

[73] Assignee: Fichtel & Sachs AG, Schweinfurt, Fed. Rep. of Germany

[21] Appl. No.: 88,032

[22] Filed: Aug. 18, 1987

Related U.S. Application Data

[63] Continuation of Ser. No. 807,261, Dec. 10, 1985, abandoned.

[30] Foreign Application Priority Data

Dec. 14, 1984 [DE] Fed. Rep. of Germany ..... 3445595

[51] Int. Cl.[4] ..... E05B 65/36

[52] U.S. Cl. ..... 70/264; 292/201; 74/527; 200/308

[58] Field of Search ..... 74/586, 584, 593, 579 R, 74/53, 33, 30, 422, 503, 502, 527; 188/67; 70/267, 262, 263, 280, 257; 292/201, 336.3; 116/279, DIG. 17, 324; 200/340, 308

[56] References Cited

U.S. PATENT DOCUMENTS

| | | | |
|---|---|---|---|
| 2,057,008 | 10/1936 | Carlson | 74/579 X |
| 2,190,572 | 2/1940 | Schottenberg | 74/33 |
| 2,637,196 | 5/1953 | Seaver et al. | 70/264 |
| 3,287,513 | 11/1966 | McFarland | 74/584 X |
| 3,370,143 | 2/1968 | Barney | 200/340 |
| 3,667,651 | 6/1972 | Shapiro | 74/33 X |
| 3,786,686 | 1/1974 | Hay | 74/33 |
| 3,789,742 | 2/1974 | Hershman et al. | 188/67 X |
| 3,793,903 | 2/1974 | Pellman | 188/67 X |
| 3,940,578 | 2/1976 | Painton | 200/340 X |
| 4,190,274 | 2/1980 | Gross et al. | 188/67 X |
| 4,273,225 | 6/1981 | Swanson | 188/67 X |
| 4,458,887 | 7/1984 | Shimokurg et al. | 188/67 X |
| 4,484,510 | 11/1984 | Hirzel | 188/67 X |
| 4,533,804 | 8/1985 | Kramer | 200/340 X |
| 4,553,445 | 11/1985 | Holbrook et al. | 74/422 X |
| 4,669,283 | 6/1987 | Ingenhoren | 292/201 X |

FOREIGN PATENT DOCUMENTS

| | | | |
|---|---|---|---|
| 1809460 | 6/1970 | Fed. Rep. of Germany | 188/67 |
| 3226295 | 1/1984 | Fed. Rep. of Germany | 70/264 |
| 415419 | 10/1946 | Italy | 74/586 |
| 2013773 | 8/1979 | United Kingdom | 70/264 |
| 2144796 | 3/1985 | United Kingdom | 292/336.3 |

*Primary Examiner*—Gary L. Smith
*Assistant Examiner*—Rodney M. Lindsey
*Attorney, Agent, or Firm*—Toren, McGeady & Associates

[57] ABSTRACT

The invention relates to a central locking installation having individual operating devices in each of which a push rod is longitudinally displaceable by means of a drive arrangement in the direction of a guide part formed by the housing of the operating device, while inhibitor means are provided for the inhibition of the displaceability of the push rod in one region of its displacement path. Thus without appreciable manufacturing expense it is achieved in the simplest manner that operating devices thus equipped can also be used at those locking points of a motor vehicle where merely in the manual pressing shut of this locking point a slight displacement of the push rod could occur which can result in unintended tripping of the microswitch and thus central locking of all locking points.

4 Claims, 1 Drawing Sheet

OPERATING DEVICE FOR A CENTRAL LOCKING INSTALLATION

This is a continuation of application Ser. No. 807,261, filed Dec. 10, 1985 now abandoned.

BACKGROUND OF THE INVENTION

This invention relates to an operating device for a central locking installation.

In central locking installations on modern passenger cars a central locking operating device is arranged at least on the trunk lid as well as on each of the doors. With such equipment, that is if the lock in the trunk lid is assembled with vertical push rod, under some circumstances it can occur that if the trunk lid is slammed shut, or in some cases even in the pressing shut of the lock, the push rod of the central locking operating device is unintentionally moved in the direction of the "door closed" position. Thus then, through the micro-switch actuated in pulse manner by the push rod, the central electronic system is caused centrally to lock all doors and other closure points of the vehicle. If the driver's door had previously been closed, the user of the vehicle is "locked out", which is especially troublesome if the ignition key, which mostly also serves as door key, had remained in the ignition switch.

The invention is based upon the problem of taking precautions so that the inadequacies described above can reliably be avoided.

SUMMARY OF THE INVENTION

In accordance with the invention, in order to solve this problem an inhibitor device is provided by means of which the force necessary for the displacement of the push rod is increased in a part of the displacement path of the push rod. With such a measure inter alia it is achieved that, without special means, the use of a central locking operating device is possible in a reliable manner even on the trunk lid of a motor vehicle without possibility of occurrence of the troubles set forth at the outset.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE DRAWINGS

In the Figures, 1 designates the entire housing of an operating device of a central locking installation, the upper part of the housing being represented partly cut away. In this housing 1 there is provided a passage 2 for the reception and guidance of a push rod 3 movable in the longitudinal direction. This rod is shown in the "door open" operational position. The transmission serving for the actuation of the push rod 3 and also the reversible electric drive motor are shown diagrammatically at 3*a*. In the "door closed" operational position the push rod 3 is retracted into the housing 1.

Figure 1:
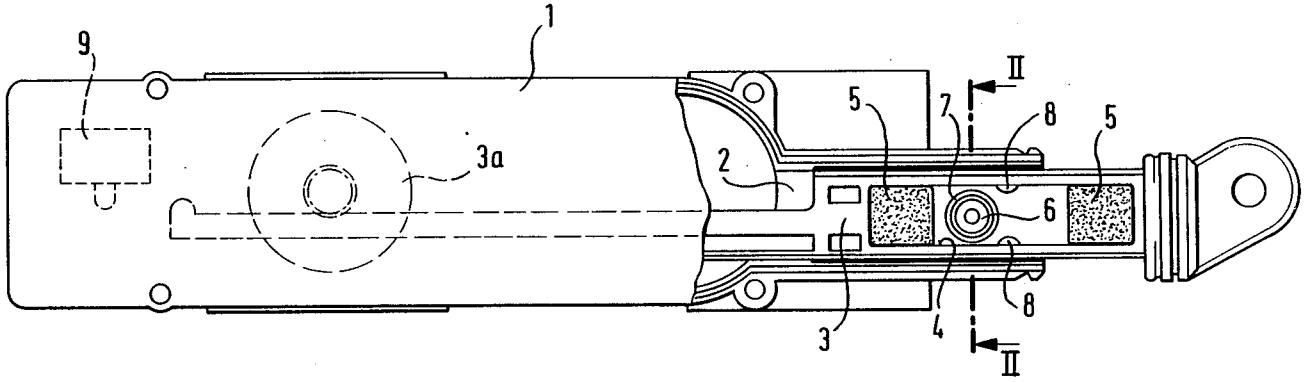
FIG. 1 shows a central locking operating device in plan view with housing partially cut away.
Figure 2:
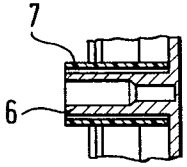
FIG. 2 shows a partial representation of FIG. 1 in lateral elevation, seen along a line II—II in FIG. 1.

In its forward region protruding out of the passage 2 of the housing 1 the push rod 3 comprises a window-type, slot-like opening 4 which extends in the direction of movement of the push rod 3 and has a rubber buffer 5 at each of its ends. These buffers 5 abut at the respective end positions of the push rod 3 on a pin 6 which is arranged in the housing 1 and penetrates the slot-like opening 4 in the push rod 3 transversely of its direction of movement and serves for the limitation of the stroke of the push rod 3, through the intermediary of the rubber buffers 5. This stop pin 6 is surrounded with play by a radially resilient cylindrical bush 7 which corresponds in external diameter nearly to the width of the longitudinal slot 4 in the push rod 3, as may be seen especially from FIG. 1.

The longitudinal opening 4 in the push rod 3 comprises—lying oppositely to one another perpendicularly of the direction of displacement—detent elements on both sides in the form of ribs 8 which extend parallel to the pin and transversely of the direction of movement of the push rod 3 and reduce the width of the slot-like opening 4 in the push rod 3. This reduction of the passage width of the push rod 3 and the resilient property of the bush 7, which is made cylindrical and expediently consists of a thin-walled synthetic plastics part, are adapted to one another in such a way that in the case of a longitudinal movement of the push rod 3 over its entire path of displacement the spring stress of the bush 7 has to be overcome in one region, that is in the region of the ribs 8.

The ribs 8 are expediently provided approximately in the middle of the whole path of displacement in the slot-like opening 4 of the push rod 3. With the arrangement of the ribs 8 in the longitudinal slot 4 of the push rod 3, in co-operation with the resilient bush 7 on the stop pin 6, the object is achieved that the transmission, especially the push rod 3, is made so stiff in motion that the transmission, that is the push rod 3, can no longer be displaced by the initially described actions—as in the closing of the trunk lid alone—so far that a microswitch 9 is tripped. Easy-moving displacement of the push rod 3 is possible only as far as the point where the two ribs 8 in the slot 4 of the push rod 3 come to abut on the bush 7, with the bush 7 being applied to the stationary pin 6. When the push rod 3 is in such a position the microswitch 9 cannot yet be actuated.

Displacement of the push rod 3 further out of this above-described position is possible only by a noticeably greater application of force, which can be defined exactly by the form of the ribs 8 and the stress force of the bush 7. It can thereby be achieved that the actuation of the operating device by means of the key is not excessively stiff.

When the configuration of the central locking operating device in accordance with the invention with ribs 8 in the longitudinal slot 4 of the push rod 3 and a resilient bush 7 stationary in the range of displacement of the push rod 3, it is very expedient that this bush 7 is usable as an additional part so that—according to the location of use—the central locking operating devices can be equipped according to choice. It has already been mentioned that the force for the further movement of the push rod 3 beyond the region marked by the ribs 8 is influenceable by the selection of the resilience properties of the bush 7.

Finally it should also be mentioned that the wear of this resilient bush 7 is very slight, because it is loaded only briefly at the moment of change-over, that is in the passing of the constriction formed by the ribs 8.

While specific embodiments of the invention have been shown and described in detail to illustrate the application of the inventive principles, it will be understood that the invention may be embodied otherwise without departing from such principles.

I claim:

1. An operating device for a central locking installation, comprising (a) a housing (1)

(b) an elongated push rod (3) guided by the housing (1) for displacement in the elongated direction of said push rod between a first "door open" position and a second "door closed" position, said push rod has an opening (4) therethrough elongated in the elongated direction of said push rod, (c) a drive device (3*a*) driving the push rod between the first position and the second position, and (d) an inhibitor device (6, 7, 8) located in the path of movement of the push rod between the first and second positions for increasing a displacement force to be exerted upon the push rod during its displacement along its path of movement between the first and second positions so that further movement of said push rod can not be effected until said inhibitor device is overcome said inhibitor device (6, 7, 8) comprises a pin (6) secured in a stationary position on said housing (1) and extending through said opening (4) transversely of the elongated direction of said opening, and at least one detent device (8) on said push rod projecting from a side of the opening extending in the elongated direction of said push rod into the opening, said detent device (8) moves with said push rod and is locatable opposite said pin (6) during the movement of said push rod between the first and second positions, a resilient bush (7) laterally encircling said pin and engageable with said detent device (8) when said detent device is opposite the pin for increasing the displacement force required for moving the push rod between the first and second positions.

2. An operating device according to claim 1, wherein said detent device comprises a pair of detent elements (8) provided each on a mutually opposite side of the opening (4) extending in the elongated direction of said push rod (3).

3. An operating device according to claim 2, wherein the detent elements are formed as ribs extending parallel to the axis of the bush and lying opposite to one another perpendicularly of the path of movement of the push rod.

4. An operating device according to claim 1, wherein the bush is of cylindrical form and is formed of elastic synthetic plastics material.

* * * * *